US009101222B2

(12) United States Patent
Minkoff et al.

(10) Patent No.: US 9,101,222 B2
(45) Date of Patent: Aug. 11, 2015

(54) FAN-COOLED COLLAPSIBLE CANOPY CHAIR

(71) Applicants: Jarett Minkoff, Gaithersburg, MD (US); Barry Freedman, Gaithersburg, MD (US)

(72) Inventors: Jarett Minkoff, Gaithersburg, MD (US); Barry Freedman, Gaithersburg, MD (US)

( * ) Notice: Subject to any disclaimer, the term of this patent is extended or adjusted under 35 U.S.C. 154(b) by 0 days.

(21) Appl. No.: 13/938,415

(22) Filed: Jul. 10, 2013

(65) Prior Publication Data

US 2014/0097652 A1 Apr. 10, 2014

Related U.S. Application Data

(60) Provisional application No. 61/710,303, filed on Oct. 5, 2012.

(51) Int. Cl.

| | |
|---|---|
| ***A47C 4/28*** | (2006.01) |
| ***A47C 7/66*** | (2006.01) |
| ***A47C 7/74*** | (2006.01) |

(52) U.S. Cl.

CPC ..... *A47C 7/744* (2013.01); *A47C 4/286* (2013.01); *A47C 7/66* (2013.01)

(58) Field of Classification Search

CPC ..... A47C 1/14; A47C 1/146; A47C 4/28; A47C 4/286; A47C 7/66; A47C 7/72; A47C 7/74; A47C 7/744; A47C 7/742

USPC ..... 297/16.1, 16.2, 38, 46, 180.13, 180.14, 297/184.15; 62/261

See application file for complete search history.

(56) References Cited

U.S. PATENT DOCUMENTS

| | | | | |
|---|---|---|---|---|
| 3,228,317 | A | 1/1966 | Westman | |
| 5,172,711 | A | 12/1992 | Mueller et al. | |
| 5,397,268 | A * | 3/1995 | Chang et al. | 454/338 |
| 6,298,866 | B1 | 10/2001 | Molnar, IV | |
| 6,325,084 | B1 | 12/2001 | Cohen | |
| 6,409,206 | B1 * | 6/2002 | Willrich | 280/658 |
| 7,150,162 | B1 * | 12/2006 | Brunner | 62/306 |
| 7,866,743 | B1 * | 1/2011 | Russell et al. | 297/180.12 |
| 8,123,290 | B1 * | 2/2012 | Aiken et al. | 297/180.1 |
| 8,262,149 | B1 * | 9/2012 | Russ | 296/102 |
| 2007/0293136 | A1 * | 12/2007 | Hancock | 454/143 |
| 2008/0100107 | A1 * | 5/2008 | Paslawski | 297/217.4 |
| 2009/0039685 | A1 * | 2/2009 | Zernov | 297/16.2 |
| 2009/0218856 | A1 * | 9/2009 | Sykes et al. | 297/184.15 |
| 2009/0268923 | A1 * | 10/2009 | Li | 381/77 |
| 2010/0102600 | A1 * | 4/2010 | Lovley, II | 297/184.15 |
| 2010/0283295 | A1 * | 11/2010 | Smith et al. | 297/16.2 |
| 2011/0181078 | A1 * | 7/2011 | Kelly et al. | 297/16.1 |
| 2011/0193372 | A1 * | 8/2011 | Pizzuto | 297/16.1 |
| 2011/0284045 | A1 * | 11/2011 | Reeb et al. | 135/151 |
| 2012/0313405 | A1 * | 12/2012 | Eckman et al. | 297/180.12 |
| 2014/0265462 | A1 * | 9/2014 | Fleming | 297/180.14 |

* cited by examiner

*Primary Examiner* — Ryan Kwiecinski

(74) *Attorney, Agent, or Firm* — Daniel Boudwin; Global Intellectual Property Agency LLC

(57) ABSTRACT

A collapsing canopy chair having an active cooling means is provided. The device comprises a collapsing, outdoor chair structure that includes a fabric seat supported by a folding seat frame. Above the chair structure is an overhead canopy assembly that supports a fan unit therein. The fan unit is supported along the surface of the canopy and within an aperture therethrough. The fan is further electrically connected to a power source supported on the chair structure and controlled by an activation switch along one arm rest of the chair structure. The switch allows a user to operably initiate the fan unit for improved ventilation under the canopy and for convective cooling in warm environments.

7 Claims, 4 Drawing Sheets

FAN-COOLED COLLAPSIBLE CANOPY CHAIR

CROSS REFERENCE TO RELATED APPLICATION

This application claims the benefit of U.S. Provisional Application No. 61/710,303 filed on Oct. 5, 2012, entitled "FAN CHAIR." The above identified patent application is herein incorporated by reference in its entirety to provide continuity of disclosure.

BACKGROUND OF THE INVENTION

1. Field of the Invention

The present invention relates to a collapsible chair that is typically used for seating in an outdoor environment. More specifically, the present invention pertains to a collapsing chair having a canopy that supports an active cooling system, whereby the user can regulate the temperature under the canopy while seated in hotter environments. The assembly provides a means for keeping the occupant comfortable by providing a breeze produced from an imbedded fan unit in the canopy assembly.

Folding and collapsing chairs are well known in the art. These devices are well adapted for providing a temporary means of support for a seated user, typically in an outdoor environment or for temporary gatherings. A popular embodiment of the collapsible chair is the tailgate style chair, which includes several brace elements that spread to support a fabric arm chair assembly. This style of chair is particularly popular because of its ability to stow into a carry pouch and expand into a comfortable outdoor furniture item when deployed.

Several folding chairs include attachments that enhance the comfort of the chair, particularly for those utilized outdoors and for leisure activities. Some common attachments include elevated leg rests, extended head rests, and overhead canopies supported by the chair. While leg rests and head rests provide for improved ergonomics and comfort, they do little to shroud a seated user from sun exposure. A canopy chair is deployed when direct sunlight on the seated user is not otherwise desired, thereby providing a cool seating environment. However, during particularly hot or humid days, simply blocking direct sunlight is not sufficient to remain cool and dry. The present invention relates to an improvement to collapsible chairs, and particularly to those chairs that employ an overhead canopy.

The present invention provides an active cooling system that adds convection cooling to the shade already provided by a canopy chair, whereby a fan unit is provided within the canopy to create a breeze for the user's comfort. The fan unit draws air over the user, who can control the operation of the unit while seated. The fan unit and supporting electrical connections are supported by the collapsible chair structure, which can readily collapse into a stowed state for storage and transport in a carry bag.

2. Description of the Prior Art

Devices have been disclosed in the prior art that relate to actively cooled canopies and sunshades. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

Devices described in the prior art generally relate to articles having canopies or overhangs with either a forced air fan or a misting system therein. These generally include umbrellas, sunshades, and carriages having a combination of sunshade and convective cooling. While related to the present invention, these devices fail to disclose a collapsible canopy chair structure that allows for use in outdoor spaces and while traveling. The present invention is an improvement on the existing collapsible chair, and adds a means of actively cooling the user using a small fan unit that does not interfere with the stowed state of the chair.

Specifically, U.S. Pat. No. 6,298,866 to Molnar discloses a table umbrella having a tubular support and a fan connected thereto. The fan is adapted to draw air upwards and away from users beneath the umbrella, where a baffle is utilized to direct the air along the umbrella underside surface and outward therefrom. While providing a sunshade article having a fan cooling means, the Molnar device describes an umbrella structure that is not suited for use in conjunction with a collapsing chair. The present invention pertains to an integrated chair canopy having a cooling means disposed therein.

Another such device is U.S. Pat. No. 6,325,084 to Cohen, which discloses a combination umbrella and fan device that includes a vinyl canopy, an umbrella hub, umbrella shaft, and an internal fan along the shaft. The fan includes several splines that act to create a breeze beneath the umbrella, cooling users thereunder by convective cooling. Similar to the Molnar device, the Cohen device provides an airflow means attached to an umbrella as opposed to one that is supported by a canopy chair. The present invention requires no internal shaft and includes no exposed fan splines.

U.S. Pat. No. 7,150,162 to Brunner discloses a stroller having an upper canopy for shrouding a child from sunlight. Within the canopy is a misting system, comprising a misting nozzle, a fluid reservoir, and a fan for spreading the misted air. The Brunner device is directed to a child's stroller, and is not suited for adult use. The present invention provides an air flow means that is attached to a collapsing chair. No misting system is contemplated.

Finally, U.S. Pat. No. 5,397,268 to Chang discloses a sunshade and fan device for blocking out sunlight and actively cooling a user thereunder. The device includes a shading disc having an opening therethrough, which supports a fan assembly directing air through the disc. Attached to the disc is a mounting assembly for clipping the device to a chair or similar structure nearby the user. While providing sunshade and active cooling, the Chang device is a furniture attachment rather than a collective chair assembly that offers protection from direct sunlight and airflow means.

The present invention describes a new and novel canopy chair with active cooling. It is submitted that the present invention is divergent in design elements from the prior art, and consequently it is clear that there is a need in the art for an improvement to existing canopy chair devices. In this regard the instant invention substantially fulfills these needs.

SUMMARY OF THE INVENTION

In view of the foregoing disadvantages inherent in the known types of canopy chairs now present in the prior art, the present invention provides a new canopy chair with an active cooling means, wherein the same can be utilized for providing convenience for the user when tailgating or engaging in other outdoor activities in hot or humid climates.

It is therefore an object of the present invention to provide a new and improved canopy chair device that has all of the advantages of the prior art and none of the disadvantages.

It is another object of the present invention to provide a canopy chair device that comprises a collapsible chair structure and a collapsible overhead canopy, whereby the device can collapse into a stowed state that permits ease of transport.

Another object of the present invention is to provide a canopy chair device that includes a fan unit positioned within the canopy to force air onto the user for convective cooling in warmer environments.

Yet another object of the present invention is to provide a canopy chair device that includes a fan unit being battery powered and operated by the seated user.

Another object of the present invention is to provide a canopy chair device that comprises an assembly that is capable of being collapsed and placed into a convenient travel bag with a carrying strap.

A final object of the present invention is to provide a canopy chair device that may be readily fabricated from materials that permit relative economy that are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
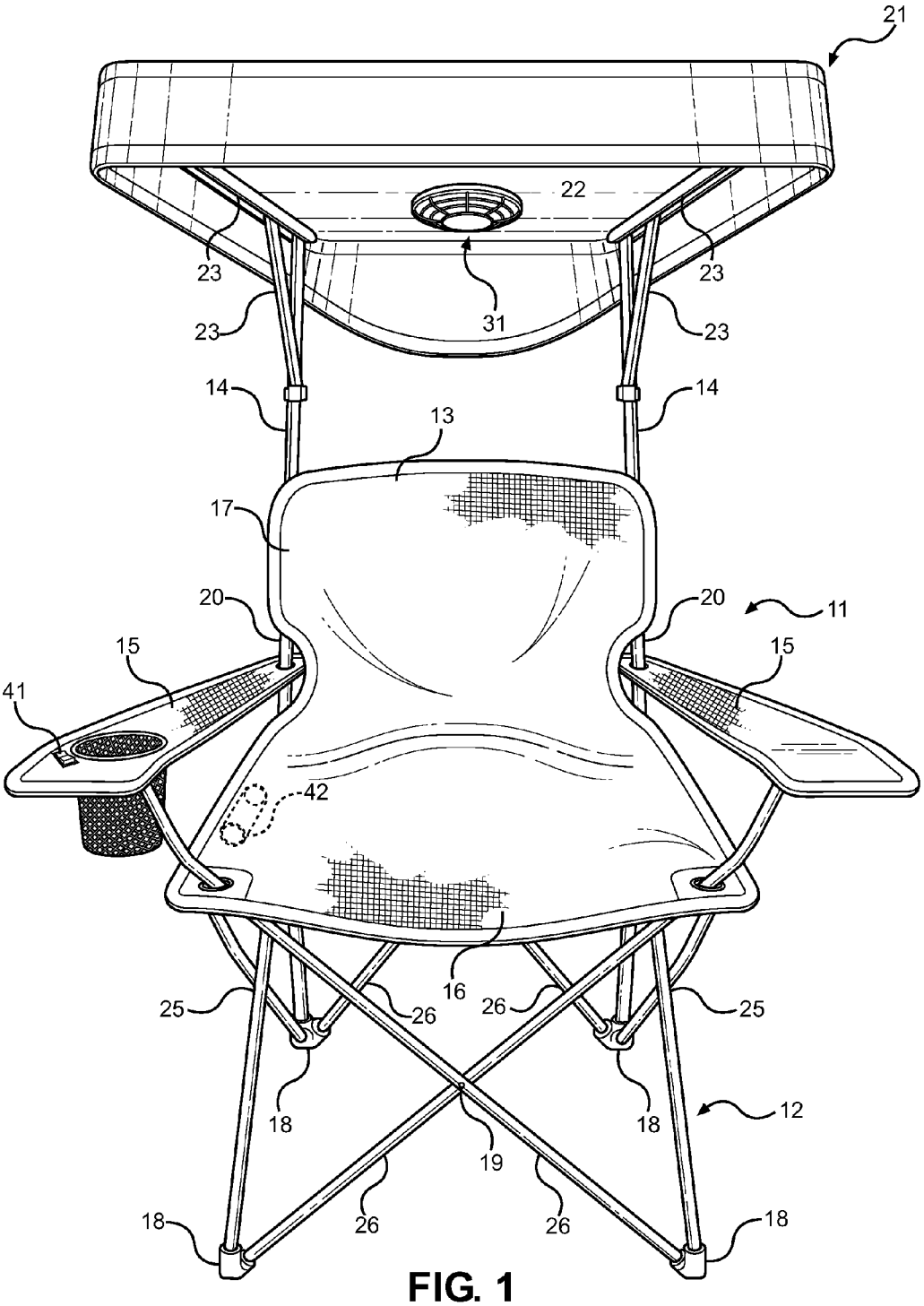
FIG. 1 shows a frontal perspective view of the canopy chair.

Reference is made herein to the attached drawings. Like reference numerals are used throughout the drawings to depict like or similar elements of the canopy chair. For the purposes of presenting a brief and clear description of the present invention, the preferred embodiment will be discussed as used for providing a collapsible canopy chair that includes a forced air cooling means. The figures are intended for representative purposes only and should not be considered to be limiting in any respect.

Figure 2:
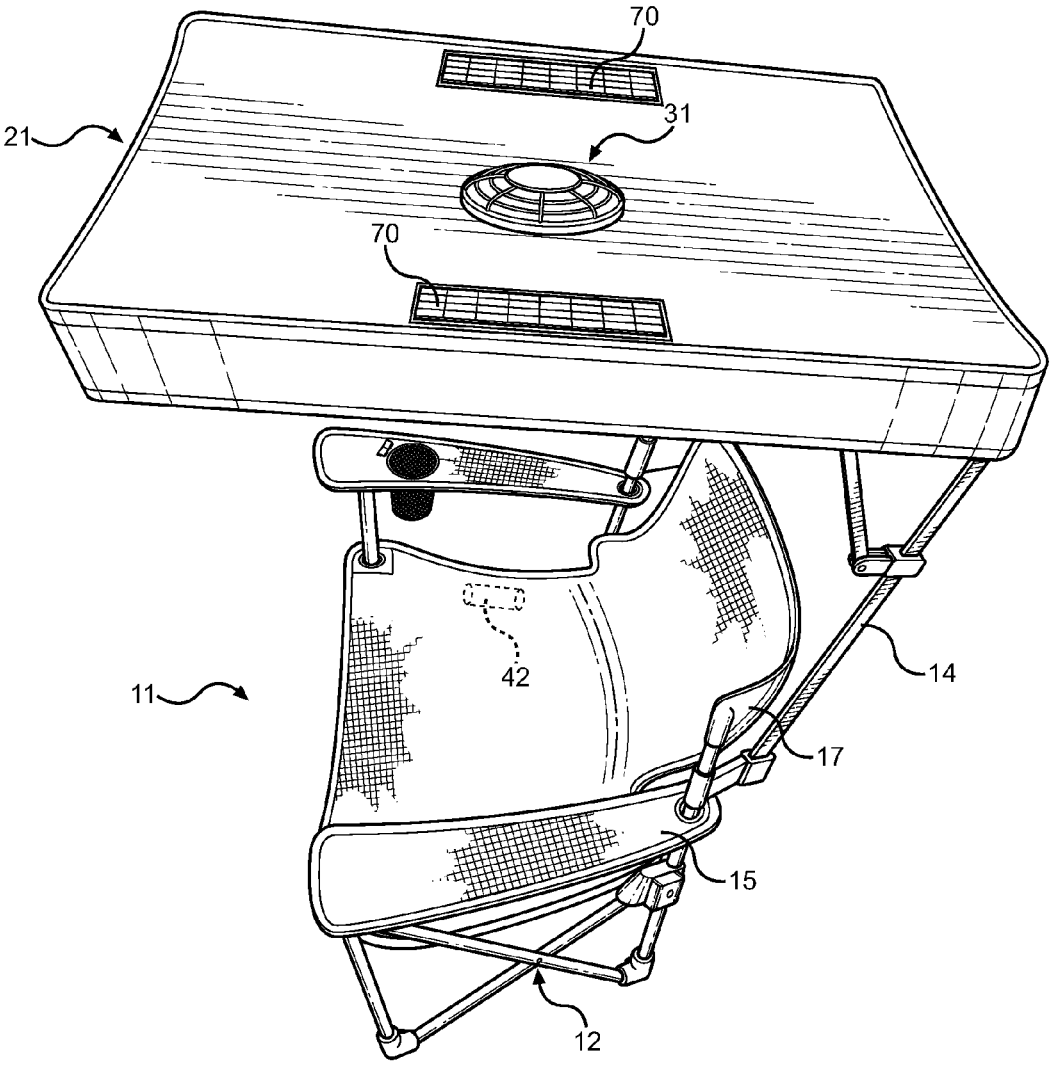
FIG. 2 shows a view of the chair arm structure and fan unit control switch.

Referring now to FIGS. 1 and 2, there is shown a frontal view of the canopy chair of the present invention. The device is a collapsible assembly that comprises a chair structure 11 connected to a canopy 21 positioned thereover. When deployed, the chair structure 11 supports a seated user while the overhead canopy 21 provides a shroud from direct sunlight. When collapsed, the device can be stowed into a carry bag and readily transported to a desired location where a seat may be desired.

The chair structure 11 comprises a plurality of interconnected brace members 12 that support a fabric chair body 17 and a pair of outstretched arm portions 15. The chair body 17 is supported at its ends by the brace members to form an upright seat having a lower seat portion 16 and an upstanding seatback portion 13. The arm portions 15 similarly are supported along their ends by the brace members 12 to form armrest supports under a user's arms. Both the arm portions 15 and the chair body 17 are comprised of a thin material that readily folds onto itself when the brace members 12 collapse together into a stowed state.

The brace members 12 of the chair structure 11 are comprised of an interconnected assembly of braces that is readily recognizable in the art of tailgate chairs. The members 12 form four ground supports 18 and intersections 19 along each side of the chair, whereby the intersections allow the members 12 to rotate with respect to each other while the ground supports 18 join the distal ends of each member at a common location along the ground. A set of crossing front and rear members 26 control lateral support of the chair structure 11 while allowing collapsing in the same direction, while a set of cross side members 25 provide support and ready collapsing in the fore-aft chair direction. The members 12 extend upwards through the chair body 17 to support the ends of the arm portions 15 and the upper end of the chair seatback portion 13.

Connected to the member 14 supporting the upstanding seatback portion 13 is a canopy 21 and its supporting assembly. The canopy comprises a fabric material having an upper surface 22 that is supported by a collapsing frame 23. The upper surface 22 is positioned over the chair 11 so direct sunlight is blocked and the user can enjoy sitting outdoors without being overly exposed to sunlight. Within the upper surface 22 is a fan unit 31 that functions as a forced air means for the seated user. The fan unit 31 is electrically controlled and acts to create airflow under the canopy 21 for convection cooling and for improved user comfort.

The fan unit 31 is powered by a battery pack 42 preferably situated below the seat portion 16, which supplies power to the fan unit 31 during operation and can be interchanged with new batteries when replenishment is required. Electrical connections are routed along the upstanding member 14 to the battery pack 42, and then through one arm portion 15 to provide the user with an activation switch 41 thereon. The activation switch 41 controls the flow of power from the battery pack 42 to the fan unit 31 and thus operation of the device.

In one embodiment, photovoltaic cells 70 are also deployed along the upper surface of the canopy to charge the battery pack 42, reducing energy consumption and preventing the batteries from losing charge too rapidly. The cells 70 are positioned along the canopy in a non-folding portion such that the cells 70 are not damaged when the assembly is collapsed into a stowed state.

Figure 3:
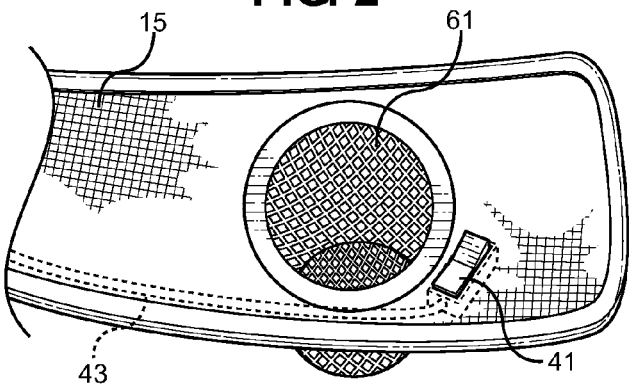
FIG. 3 shows an overhead perspective view of the canopy chair.

Referring now to FIG. 3, there is shown a view of the arm portion 15 and the activation switch 41 that controls the operation of the fan unit in the canopy. The activation switch 41 closes a circuit that activates the fan unit. This can be accomplished by a simple electrical switch, or the switch can have multiple settings for different fan speeds. Overall, the location of the switch 41 allows the seated user to control operation of the fan while thereunder, which can be used to control airflow beneath the canopy on hot and humid days. Electrical connections 43 are routed under the arm portion to connect the switch 41 to the fan unit and power supply. Also provided in the arm portion may be a cup holder pouch 61 for beverage support adjacent to the switch 41.

Figure 4:
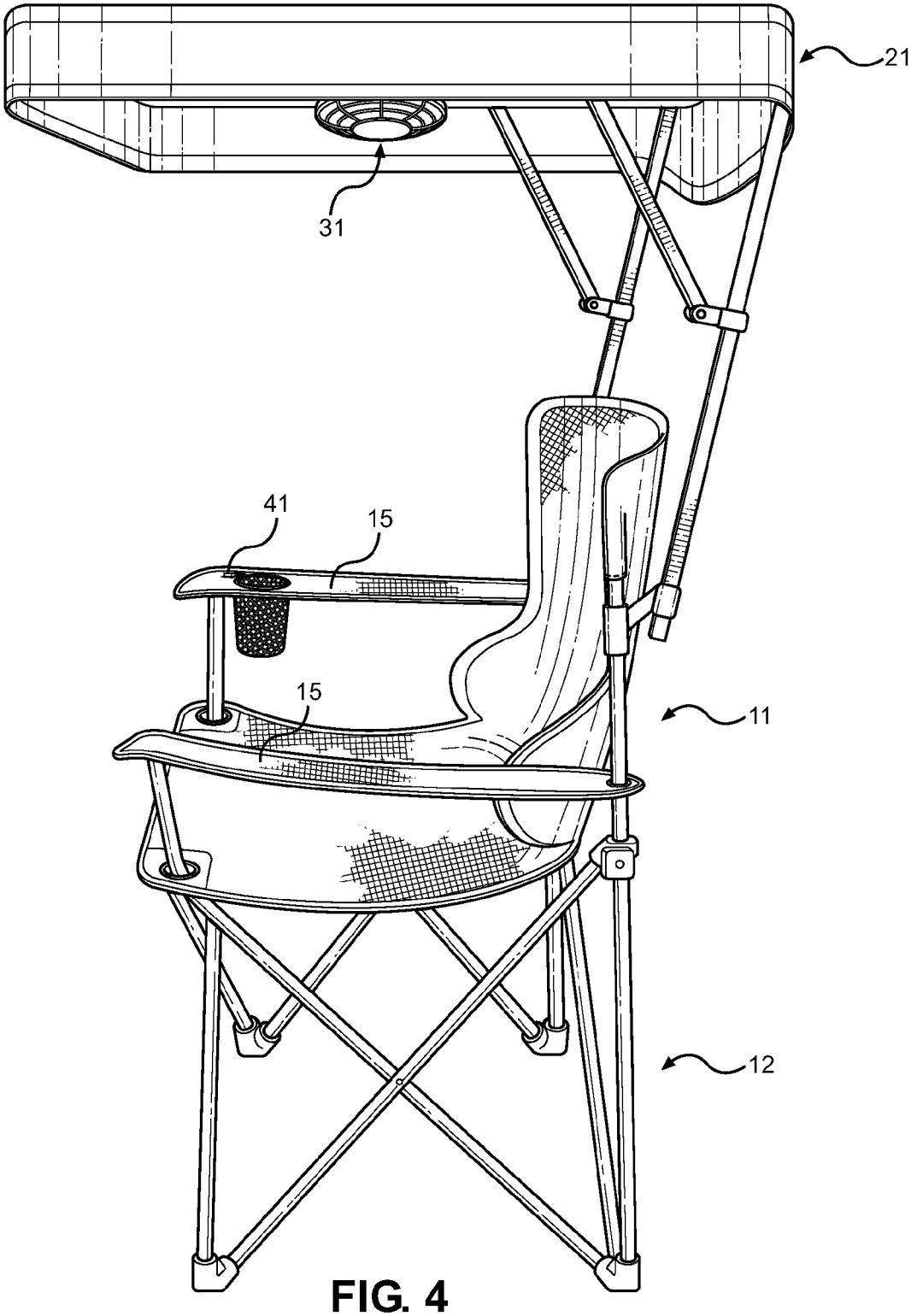
FIG. 4 shows a side view of the canopy chair.
Figure 5:
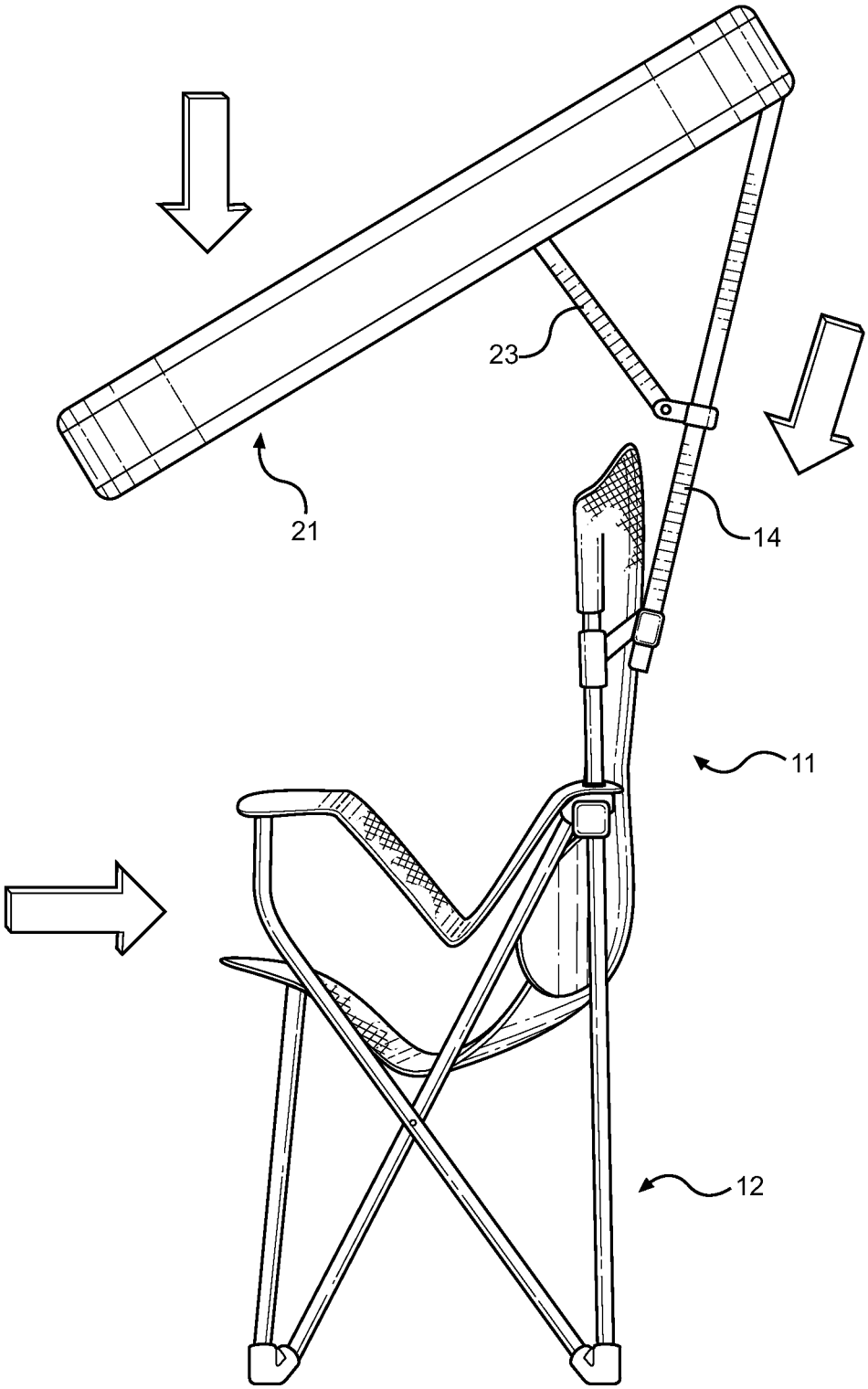
FIG. 5 shows a view of the collapsing canopy chair as it transitions from a deployed state to a stowed state.

Referring to FIGS. 4 and 5, there is shown more views of the collapsible canopy chair, wherein the deployed state is shown and the chair in the act of collapsing is shown. The assembly comprises a collapsible or folding chair, being small, medium, large or extra-large and having an adjustable, solid or flexible hinged canopy or shade cover. The canopy supports a fan unit 31 for the purpose of propelling a cooling breeze onto the occupant of the chair 11, consisting of a drive unit, fan hub and fan blades powered by a battery pack and charged using a solar array (photovoltaic cell). The fan is controlled by an activation switch 41 that may include variable speed control, such that the fan can operate at low speed, a high speed or in an off position. While the fan is keeping the occupant cool it also creates a breeze that helps to ward off flying insects from the cooling area.

In a non-exemplary embodiment, the invention includes a collapsible or folding chair with an adjustable canopy cover and an integrated cooling system. The chair 11 includes a collapsible or folding chair made out of fabric; an adjustable, solid or flexible hinged canopy 21 or shade cover; a single or multi speed fan unit 31 supported within the canopy 21 or shade cover; a power source for the fan comprising a battery pack; a solar array for charging the battery pack; an activation switch 41 built into the arm portion 15 of the chair 11 to control the speed of the fan 31; and/or a convenient travel bag with a carrying strap for supporting the assembly when in a stowed state (see FIG. 5).

An object of the present invention is to combine a folding or collapsible outdoor chair having a canopy cover with a cooling fan unit that is integrated into the canopy cover for the purpose of keeping the occupants of the chair comfortable by providing a breeze thereover. The collapsible chair includes a fabric chair body supported by a collapsible assembly of brace members, while the canopy is supported from the chair using upstanding members 14 and comprises a collapsible frame structure 23. The material of the chair brace members and the canopy frame can be constructed out of, but not limited to, metal, aluminum, plastic or steel hollow piping. The parts of the members are attached by hinges that facilitate collapsing and ready support of a seated user when deployed.

The chair structure 11 of the collapsible assembly includes a seat portion, a seat back, and extended armrests 15. The seat portion, seat back, armrests 15 and canopy 21 cover of the brace members and are constructed out of, but not limited to, sturdy fabrics, such as canvas. When sturdy fabrics are used, the collapsible chair can support both a seated person and the fan, while also readily folding onto itself when collapsing into a stowed state.

Generally, the fan unit 31 is placed in the center of the canopy cover 21. The fan 31 can be a single or multi-speed cooling fan. Locating the fan 31 in the center of the canopy 21 helps to optimize the convection cooling effect on the occupant of the chair, as heated air is removed from the area and a cool breeze helps remove heat from the user's skin, particularly during humid days where evaporative cooling is otherwise limited. The placement of the fan 31 also allows for the chair structure 11, canopy 21, and fan 31 to collapse as one unit without limiting the ability for the chair to become compact enough for packaged transport and such that the fan 31 does not become damaged during this process. Similarly, the wiring connections are routed such that changes in the geometry of the seat do not cause breakages in the wiring, separation of any connections or shorts in the circuit.

The fan 31 can be secured to the canopy 21 in any number of ways. Securing means include, but not limited to, the fan assembly being stitched directly in to the fabric of the canopy upper surface, the fan assembly having a plastic, or other material, frame around it that is adhered to the fabric of the canopy cover, or finally cross braces across the canopy surface can be deployed to support the fan unit. While the referenced drawings show a singular fan unit, it is further contemplated that multiple fans can be integrated into the canopy cover for improved airflow and an increased flow rate of air over the seated user.

A power source is provided to power the fan, which is preferably supported below the seat portion or within the canopy. One power source or multiple power sources may be used. Wiring connections are routed through the collapsible assembly to electrically connect to the fan unit to the power source, the power source to the fan activations switch, and from the solar cells to the power source. The wiring can be concealed within the fabric of the collapsible chair. In addition, piping can be added to the frame of the chair to further conceal the wiring. The piping could also be a tube or a fabric sleeve. Further, in an alternate embodiment, the canopy cover could consist of two layers and the wiring can be placed in between the two layers. Additionally, the wiring can be bendable so that it folds with the frame. Thus, the claimed invention has a built-in wire structure that allows the wiring to be concealed and also for the chair to be easily foldable and portable. Therefore, the chair is ready-to-use once it is unfolded and there is no need for additional installation or set-up. If a battery pack is depleted, a replacement set of batteries may be readily inserted.

In a non-limiting embodiment, the power source that powers the fan can be batteries alone, or a batteries trickle charged by the photovoltaic cells (solar cells). The batteries are preferably supported within a casing and attached to either the fabric of the chair or directly to the brace members or frame components of the chair/canopy. Alternatively, the batteries can be made to be integrated directly to either the fabric of the chair or the brace members/frame.

In still yet another alternate embodiment, at least one, but potentially both, arm rests will contain a beverage holder that is made of, but not limited to, a suspended mesh fabric in which a beverage or personal item can be stored. The beverage holder will be secured to the arm rest or rests with a plastic or similar material or frame that is adhered to the arm rest. Further, the fan speed control switch can be incorporated into the frame of the beverage holder on the arm rest. Additionally, in an alternate embodiment, the fan activation switch can be placed on the underside of the canopy rather than along the arm portion.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fan-cooled, collapsible canopy chair, comprising:

a chair structure having a collapsible chair body and collapsible brace members;

a collapsible canopy connected to said chair structure and positioned thereover;

an electrical fan unit in said canopy directing airflow downward onto said chair structure;

a battery power supply electrically connected to said fan unit;

an activation switch electrically connected to said battery power supply, said activation switch adapted to control said fan unit operation;

said chair structure further comprising arm portions;

said activation switch being disposed on one of said arm portions such that a seated user in said chair structure can control said fan unit operation while in a seated position;

said chair structure, said electrical fan unit, said battery power supply, and said collapsible canopy being collapsible into a stowed state and placed into a carry bag;

said chair structure and said collapsible canopy being expandable into a deployed state to support a seated user.

2. The chair of claim 1, wherein said collapsible brace members further comprise:

a set of front crossing collapsible brace members, a set of rear crossing collapsible brace members, a set of left side collapsible brace members, and a set of right side collapsible brace members each having a brace member intersection, each of said brace member intersections permitting said collapsible brace members to rotate with respect to each other;

four ground supports, said four ground supports joining a distal end of a collapsible brace member of one of said sets with a corresponding distal end of a collapsible brace member of an adjacent one of said sets at a common location;

wherein said front and rear collapsible brace members adapted to control lateral support of said chair structure while permitting collapsing in the same direction;

wherein said left side and right side collapsible brace members providing support and permitting readily collapsing in a fore-aft chair structure direction; and wherein at least one of said collapsible brace members extending upwards through said chair body to support said chair body.

3. The chair of claim 1, further comprising a photovoltaic solar cell for charging said battery power supply.

4. The chair of claim 1, wherein said battery power supply is supported below said chair body.

5. The chair of claim 1, wherein said battery power supply is supported by said canopy.

6. The chair of claim 1, wherein said collapsible brace members further comprise:

a forward set of collapsible brace members crossing one another and joined by a brace member intersection therealong;

a rear set of collapsible brace members crossing one another and joined by a brace member intersection therealong;

a first side set of collapsible brace members and joined by a brace member intersection therealong;

a second side set of collapsible brace members and joined by a brace member intersection therealong;

said first side set of collapsible brace members and said second side set of collapsible brace members disposed between said forward set of collapsible brace members and said rear set of collapsible brace members to form said chair structure with four ground supports;

each of said brace member intersections permitting said collapsible brace members to rotate with respect to each other while said ground supports join their distal ends at a common location;

said forward set of collapsible brace members and said rear set of collapsible brace members adapted to control lateral support of said chair structure while allowing collapsing in a lateral direction;

said first side set of collapsible brace members and said second side set of collapsible brace members providing support in fore-aft support of said chair structure while allowing collapsing in a fore-aft direction;

a pair of upstanding members extending upwards through said chair body to support said collapsible canopy.

7. The device chair of claim 1, wherein:

said chair structure further comprises a first arm portion and a second arm portion;

a pair of upstanding members extending upwards through said chair body to support said collapsible canopy;

said first said arm portion supported between one of said upstanding members and one of said collapsible brace members;

said second arm portion supported between one of said upstanding members and one of said collapsible brace members.

* * * * *